US011976886B2

(12) United States Patent
Kuppusamy et al.

(10) Patent No.: US 11,976,886 B2
(45) **Date of Patent: *May 7, 2024**

(54) EFFICIENT SUCTION-LINE HEAT EXCHANGER

(71) Applicant: Lennox Industries Inc., Richardson, TX (US)

(72) Inventors: Karthick Kuppusamy, Salem (IN); Manian Pillai, Chennai (IN); Ranjithkumar Palanivelu, Aranthangi (IN)

(73) Assignee: Lennox Industries Inc., Richardson, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/206,689

(22) Filed: Jun. 7, 2023

(65) Prior Publication Data

US 2023/0324127 A1 Oct. 12, 2023

Related U.S. Application Data

(63) Continuation of application No. 17/236,147, filed on Apr. 21, 2021, now Pat. No. 11,709,020.

(51) Int. Cl.

| | |
|---|---|
| ***F28D 7/02*** | (2006.01) |
| ***F28D 7/16*** | (2006.01) |
| ***F28F 1/24*** | (2006.01) |
| ***F28F 13/12*** | (2006.01) |
| *F28D 21/00* | (2006.01) |

(52) U.S. Cl.

CPC ..... *F28D 7/1623* (2013.01); *F28D 7/024* (2013.01); *F28F 1/24* (2013.01); *F28F 13/12* (2013.01); *F28D 2021/0068* (2013.01); *F28F 2215/00* (2013.01); *F28F 2250/00* (2013.01)

(58) Field of Classification Search

CPC ..... F28D 7/02; F28D 7/024; F25B 39/028; F28F 13/12; F28F 13/125

See application file for complete search history.

(56) References Cited

U.S. PATENT DOCUMENTS

| | | | |
|---|---|---|---|
| 2005/0109486 | A1 | 5/2005 | Memory et al. |
| 2008/0245502 | A1 | 10/2008 | Knaus et al. |
| 2010/0243200 | A1 | 9/2010 | Baker, Jr. et al. |
| 2012/0102989 | A1 | 5/2012 | Gov et al. |
| 2013/0213081 | A1 | 8/2013 | Zhang et al. |
| 2016/0091232 | A1 | 3/2016 | Gov et al. |

(Continued)

FOREIGN PATENT DOCUMENTS

| | | | |
|---|---|---|---|
| CA | 3061927 | C | 8/2020 |
| CN | 101140145 | A | 3/2008 |

(Continued)

*Primary Examiner* — Eric S Ruppert

(57) ABSTRACT

A heat exchanger includes a shell, a coiled tube, and a swirler. The shell has an inlet and an outlet and forms a cavity. A first of a liquid refrigerant and a vapor refrigerant enters the inlet of the shell. The coiled tube is positioned within the cavity and is connected to an inlet tube from outside the shell and an outlet tube to outside the shell. A second of the liquid refrigerant and the vapor refrigerant enters the inlet tube of the coiled tube. The swirler is arranged adjacent the inlet of the shell and is dimensioned to distribute the first of the liquid refrigerant and the vapor refrigerant across the coiled tube.

20 Claims, 9 Drawing Sheets

(56) References Cited

U.S. PATENT DOCUMENTS

| | | | |
|---|---|---|---|
| 2016/0178256 | A1 | 6/2016 | Zhang et al. |
| 2017/0131039 | A1 | 5/2017 | Wongwises |
| 2018/0202727 | A1 | 7/2018 | Basini |
| 2019/0390924 | A1 | 12/2019 | Anderson et al. |

FOREIGN PATENT DOCUMENTS

| | | | | |
|---|---|---|---|---|
| CN | 201697504 | U | * | 1/2011 |
| FR | 3024218 | | | 1/2016 |
| GB | 2298913 | A | | 9/1996 |
| GB | 2312276 | A | | 10/1997 |
| JP | 05052301 | | | 3/1993 |
| RU | 2253803 | | | 6/2005 |

* cited by examiner

EFFICIENT SUCTION-LINE HEAT EXCHANGER

CROSS-REFERENCE TO RELATED APPLICATIONS

This application is a continuation of U.S. patent application Ser. No. 17/236,147, filed on Apr. 21, 2021. U.S. patent application Ser. No. 17/236,147 is incorporated herein by reference.

TECHNICAL FIELD

The present disclosure relates generally to a suction-line heat exchanger and more particularly, but not by way of limitation, to a suction-line heat exchanger that acts as a sub-cooling economizer of refrigerant from a condenser with the help of refrigerant from an evaporator.

BACKGROUND

This section provides background information to facilitate a better understanding of the various aspects of the disclosure. It should be understood that the statements in this section of this document are to be read in this light and not as admissions of prior art.

A suction-line heat exchanger acts as an economizer to subcool liquid refrigerant from a condenser with the assistance of vapor refrigerant coming out of an evaporator. A typical design of a suction-line heat exchanger in use includes a tube-in-shell design or a pipe-in-pipe design with or without fins.

SUMMARY

This summary is provided to introduce a selection of concepts that are further described below in the detailed description. This summary is not necessarily intended to identify key or essential features of the claimed subject matter, nor is it intended to be used as an aid in limiting the scope of claimed subject matter.

A heat exchanger includes a shell, a coiled tube, and a swirler. The shell has an inlet and an outlet and forms a cavity. A first of a liquid refrigerant and a vapor refrigerant enters the inlet of the shell. The coiled tube is positioned within the cavity and is connected to an inlet tube from outside the shell and an outlet tube to outside the shell. A second of the liquid refrigerant and the vapor refrigerant enters the inlet tube of the coiled tube. The swirler is arranged adjacent the inlet of the shell and is dimensioned to distribute the first of the liquid refrigerant and the vapor refrigerant across the coiled tube.

A swirler is arranged adjacent an inlet of a heat-exchanger shell. The swirler is dimensioned to distribute refrigerant within a cavity formed by the heat-exchanger shell. The swirler includes a frustoconical cone having a first end and a second end. The first end is positioned adjacent an inlet of the heat-exchanger shell. The first end has a first diameter and the second end has a second diameter. The first diameter is less than the second diameter. The swirler also includes a plurality of blades extending from the frustoconical cone symmetrically about a circumference of the frustoconical cone.

BRIEF DESCRIPTION OF THE DRAWINGS

The disclosure is best understood from the following detailed description when read with the accompanying figures. It is emphasized that, in accordance with standard practice in the industry, various features are not drawn to scale. In fact, the dimensions of various features may be arbitrarily increased or reduced for clarity of discussion.

DETAILED DESCRIPTION

Various embodiments will now be described more fully with reference to the accompanying drawings. The disclosure may, however, be embodied in many different forms and should not be construed as limited to the embodiments set forth herein. Various embodiments have been demonstrated to improve heat transfer relative to prior solutions with minimal increase in pressure drop.

An optimized flow pattern of a suction-line heat exchanger utilizes a swirler. The swirler optimizes the flow pattern so that refrigerant flows in a way that improves heat transfer capacity of the suction-line heat exchanger. In a typical embodiment, the swirler guides the refrigerant to more evenly fill a cavity of a suction-line heat exchanger and creates turbulence in the refrigerant flow.

Figure 1:
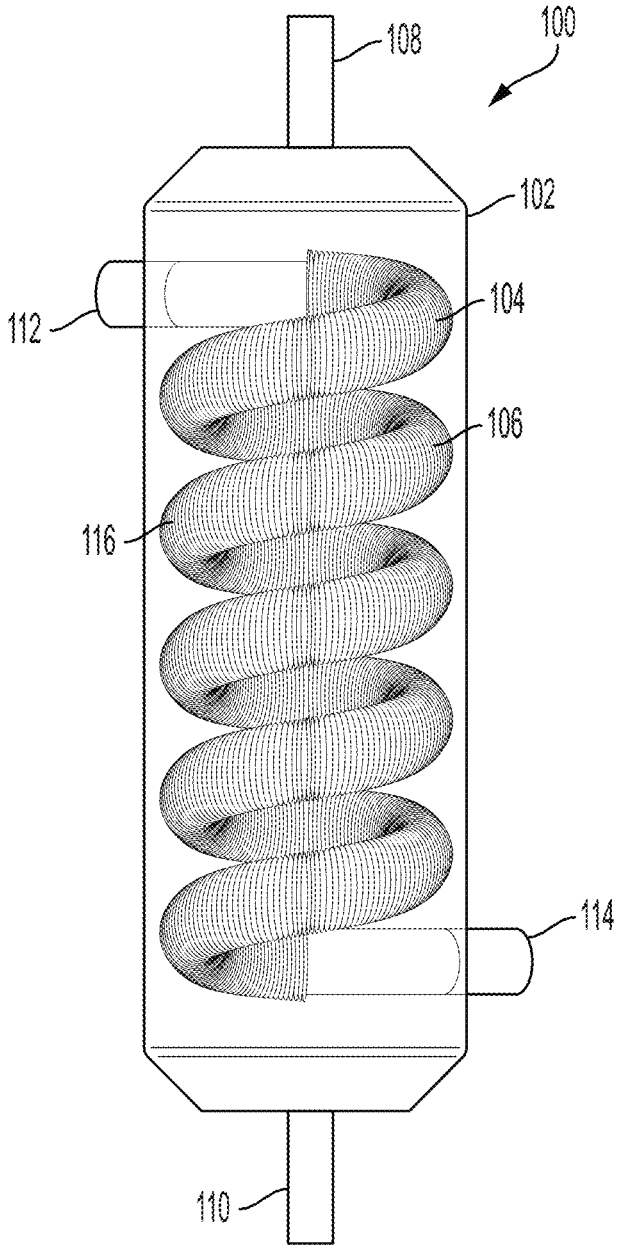
FIG. 1 illustrates a typical design of a suction-line heat exchanger.

FIG. 1 illustrates a typical design of a suction-line heat exchanger 100. In the suction-line heat exchanger 100, the suction-line heat exchanger 100 being typically referred to as a shell and tube suction-line heat exchanger. The suction-line heat exchanger 100 includes a shell 102, a coiled tube 104 contained within the shell 102, liquid-refrigerant inlet tube 108, and liquid-refrigerant outlet tube 110. The coiled tube 104 includes a vapor-refrigerant inlet 112 and a vapor-refrigerant outlet 114. A primary flow path of the liquid refrigerant within the shell 102 is denoted by reference numeral 106. The coiled tube 104 is illustrated as including fins 116, the fins 116 being serving to increase surface area of the coiled tube 104 that comes into contact with the liquid refrigerant. The liquid refrigerant enters the suction-line heat exchanger 100 from a condenser (not shown) via the liquid-refrigerant inlet tube 108 and exits the suction-line heat exchanger 100 via the liquid-refrigerant outlet tube 110. In similar fashion, vapor refrigerant enters the suction-line heat exchanger 100 from an evaporator (not shown) via the vapor-refrigerant inlet 112 and exits the suction-line heat exchanger 100 at the vapor-refrigerant outlet 114. FIG. 1 illustrates flows of the vapor refrigerant and the liquid refrigerant that are parallel, meaning they flow in the same general direction within the suction-line heat exchanger 100; however, this need not necessarily be the case. In some embodiments, one or both of the liquid-refrigerant flow and the vapor-refrigerant flow can be reversed without departing from principles of the invention. For example, if a direction of one of the vapor-refrigerant flow and the liquid-refrigerant flow is reversed from that illustrated in FIG. 1, the flows would be opposite in direction to one another and typically referred to as counter-directional.

Figure 2:
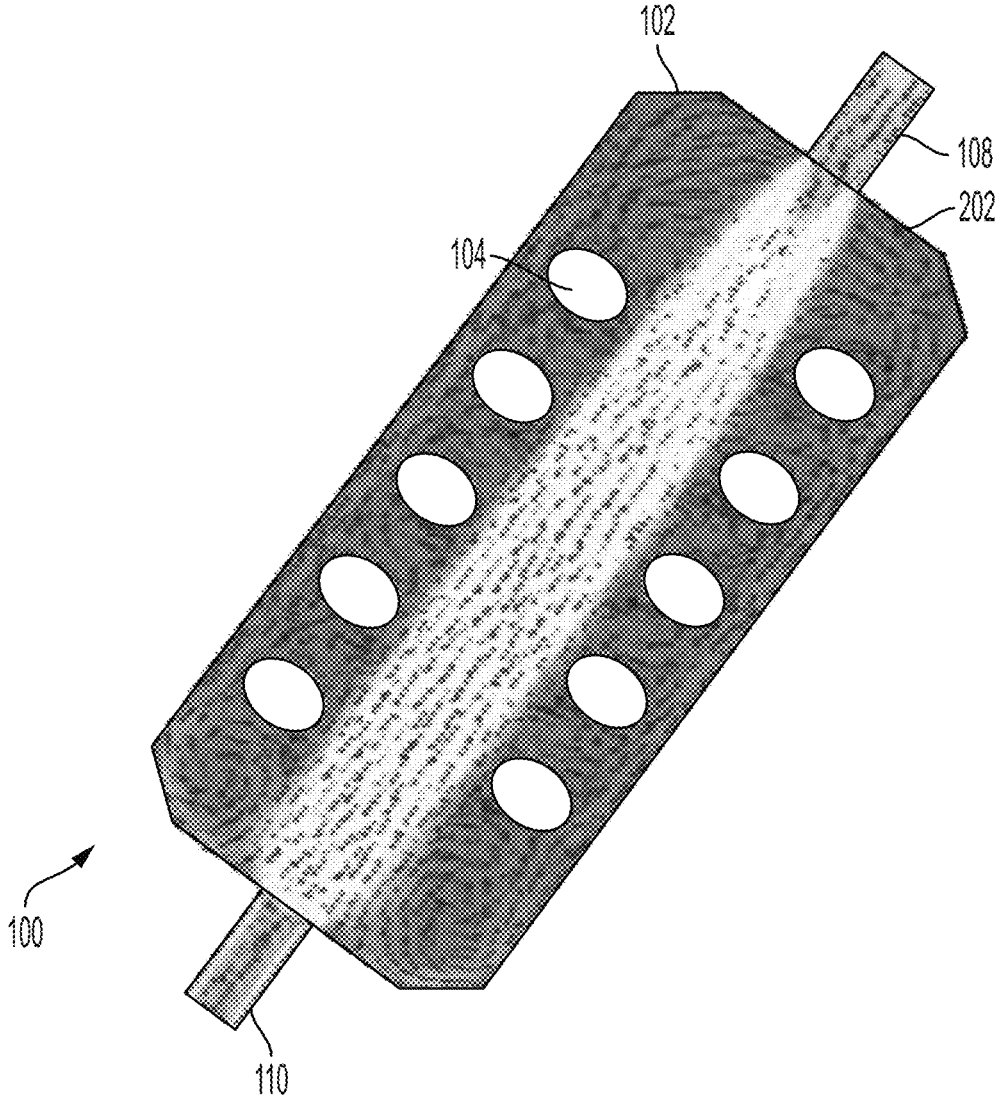
FIG. 2 is a cross-sectional representation of velocity distribution of liquid refrigerant within a shell of the suction-line heat exchanger of FIG. 1 as liquid refrigerant passes from a liquid-refrigerant inlet tube to a liquid-refrigerant outlet tube.

FIG. 2 is a cross-sectional representation of velocity distribution of liquid refrigerant within the shell 102 of the suction-line heat exchanger 100 as the liquid refrigerant passes from the liquid-refrigerant inlet tube 108 to the liquid-refrigerant outlet tube 110. As is apparent from FIG. 2, the velocity distribution of the liquid refrigerant is not even within the shell 102, but is rather more concentrated in a central internal portion of a cavity formed by the shell 102, as illustrated by liquid-refrigerant velocity distribution 202, which extends only nominally outside of the primary flow path 106 as shown in FIG. 1. As such, inclusion of the fins 116 is to a significant degree irrelevant in achieving optimal heat transfer between the liquid refrigerant and the vapor refrigerant.

Figure 3:
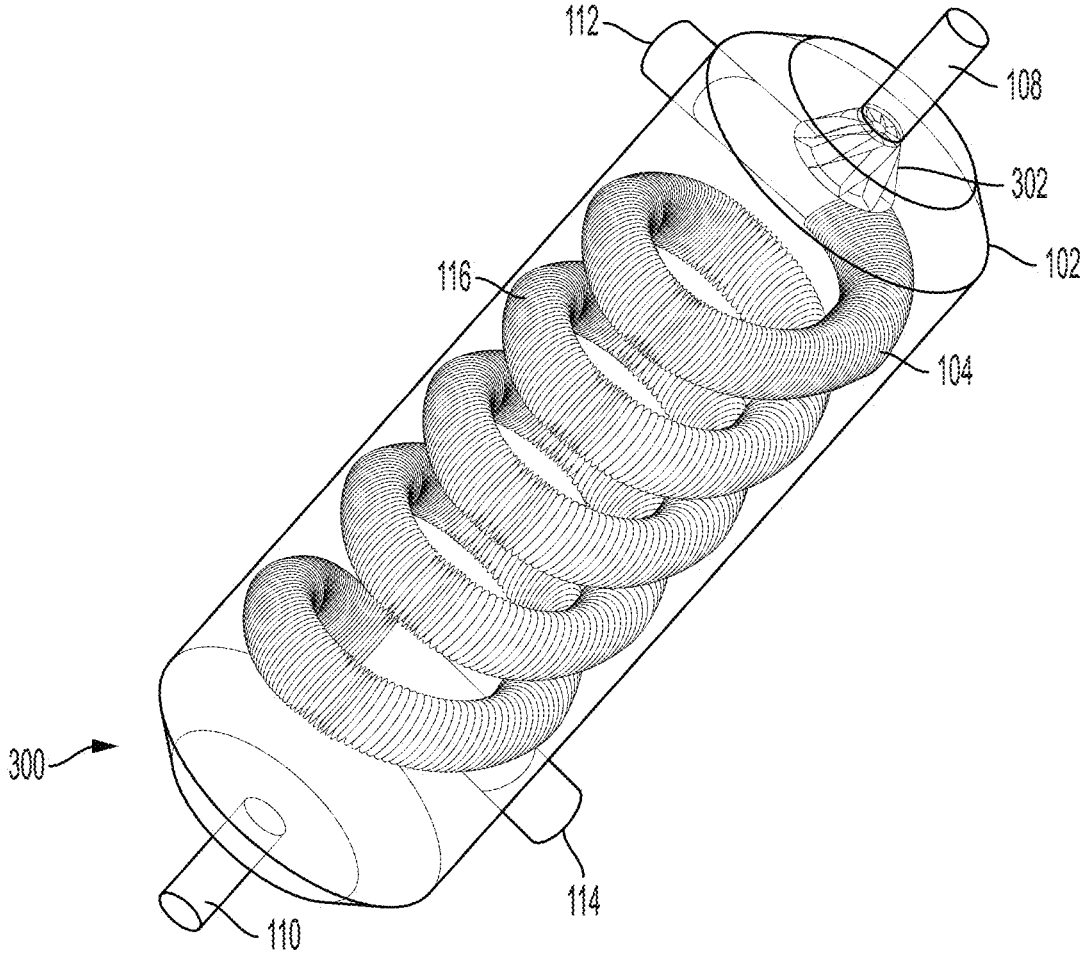
FIG. 3 illustrates a suction-line heat exchanger.

FIG. 3 illustrates a suction-line heat exchanger 300. The suction-line heat exchanger is in many respects similar to the suction-line heat exchanger 100, the main difference being the addition of a swirler 302 within the shell 102 near the liquid-refrigerant inlet tube 108. In a typical embodiment, the swirler 302 guides the liquid refrigerant entering the shell 102 via the liquid-refrigerant inlet tube 108 from the condenser towards coiled tube 104 so that, in contrast to the suction-line heat exchanger 100, the refrigerant is directed more evenly within the cavity formed by the shell 102 such that more of the coiled tube 104 comes into contact with the refrigerant and more heat transfer occurs. It is thus apparent that the swirler complements the fins 116 with respect to enhanced heat exchange.

Figure 4:
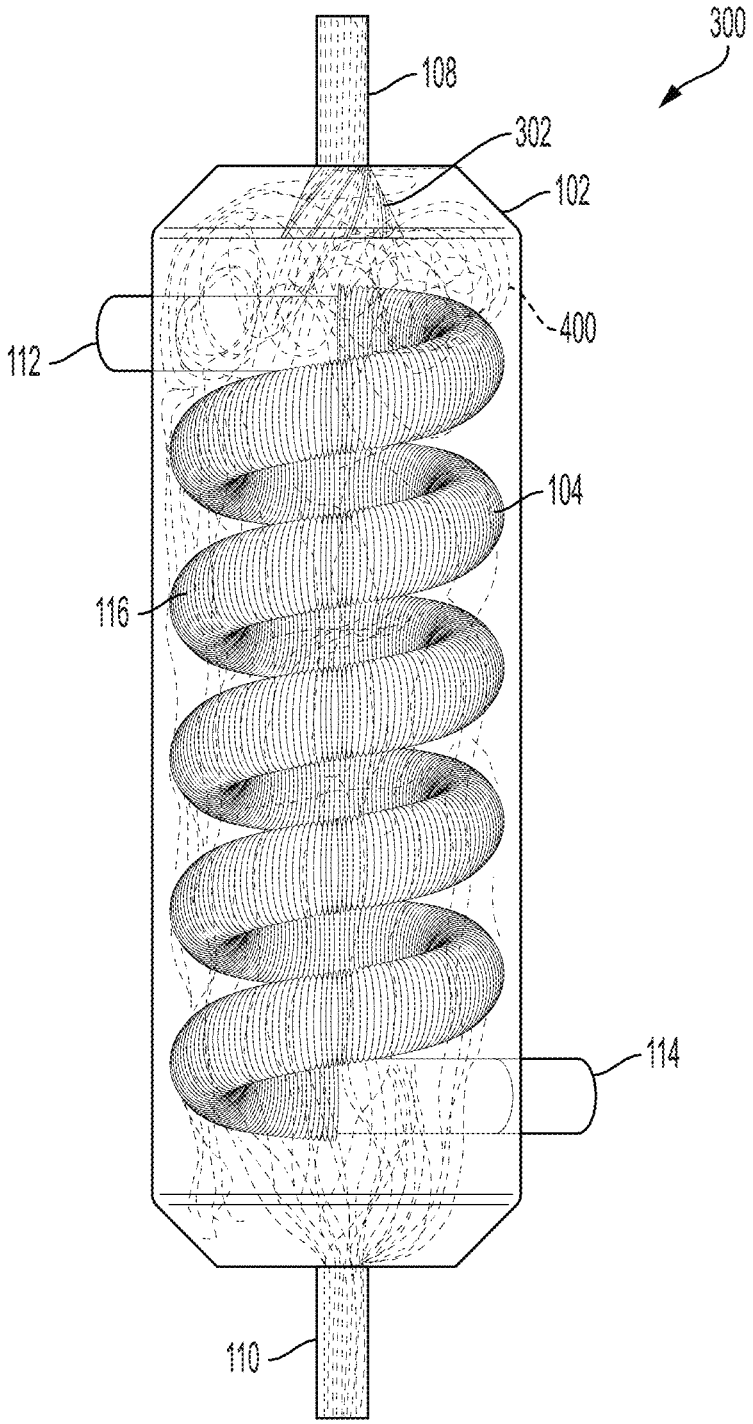
FIG. 4 is a cross-sectional representation of velocity distribution of liquid refrigerant within a shell of the suction-line heat exchanger of FIG. 3 as liquid refrigerant passes from a liquid-refrigerant inlet tube to a liquid-refrigerant outlet tube.

FIG. 4 is a cross-sectional representation of velocity distribution of liquid refrigerant within the shell 102 of the suction-line heat exchanger 300 as the liquid refrigerant passes from the liquid-refrigerant inlet tube 108 to the liquid-refrigerant outlet tube 110. As is apparent from FIG. 4, the velocity distribution of the liquid refrigerant is much more even within the shell 102 relative to that shown in FIG. 2, as illustrated by liquid-refrigerant velocity distribution 400, which extends significantly outside the primary flow path 106 as shown in FIG. 1 and covers at least 80% of a volume of the cavity formed by the shell 102. As such, inclusion of the fins 116 in order to achieve optimal heat transfer between the liquid refrigerant and the vapor refrigerant can be leveraged by virtue of better distribution of the liquid refrigerant within the cavity.

Figure 5:
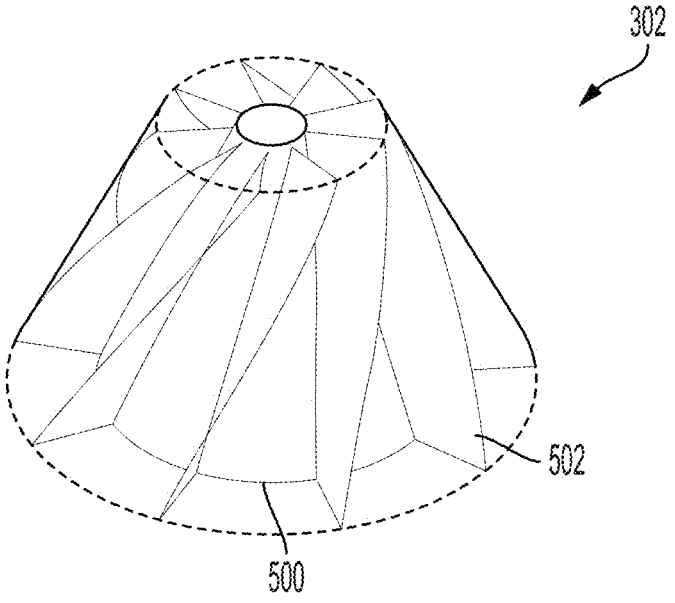
FIG. 5 illustrates the swirler of FIG. 3 apart from the remaining components of the suction-line heat exchanger of FIG. 3.

FIG. 5 illustrates the swirler 302 apart from the remaining components of the suction-line heat exchanger 300. The swirler 302 includes a frustoconical core 500 and a plurality of blades 502 extending from the frustoconical core 500, one of the blades 502 being indicated in FIG. 5 and nine of the blades 502 being shown in FIG. 5 for illustrative purposes. Those having skill in the art will recognize that more or fewer blades may be utilized in accordance with design considerations.

Figure 6A:
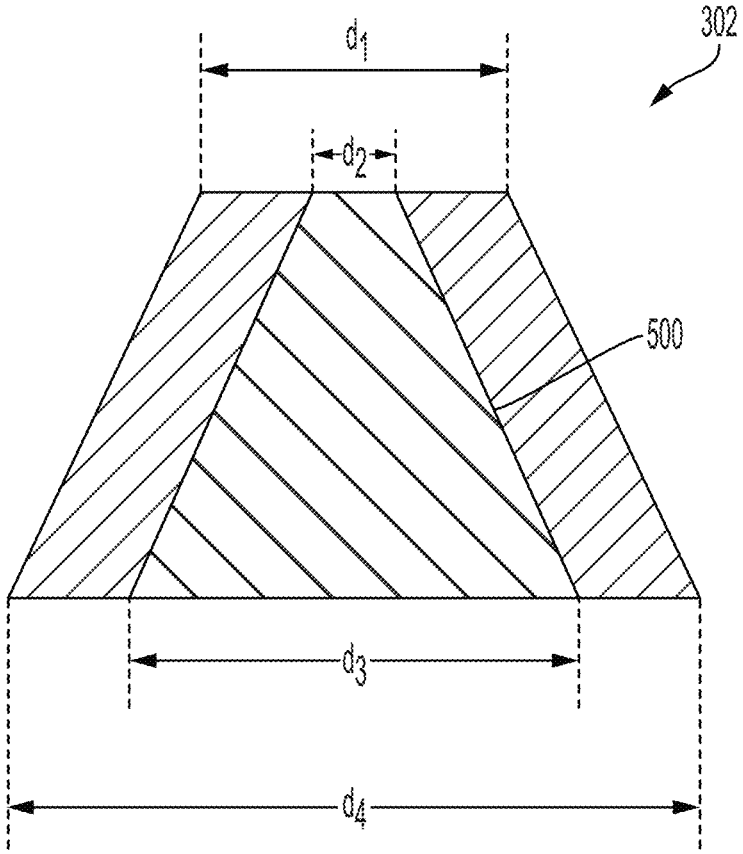
FIG. 6A illustrates a schematic side view of the swirler of FIG. 5 with particular emphasis on relative dimensions of a frustoconical core and blades thereof.

FIG. 6A illustrates a schematic side view of the swirler 302 with particular emphasis on relative dimensions of the frustoconical core 500 and the blades 502. As indicated in FIG. 6A, d1 indicates a diameter of a leading edge of the swirler 302 adjacent to the liquid-refrigerant inlet tube 108, d2 indicates a diameter of a leading edge of the frustoconical core 500 adjacent to the liquid-refrigerant inlet tube 108, d3 indicates a diameter a trailing edge of the frustoconical core 500 opposite the liquid-refrigerant inlet tube 108, d4 indicates a diameter of a trailing edge of the swirler 302 opposite the liquid-refrigerant inlet tube 108, and h1 indicates a height of the swirler 302. Those having skill in the art will appreciate that a primary direction of flow of the liquid refrigerant is in the dimension indicated by h1 from the leading edge of the swirler 302 to the trailing edge of the swirler 302. d1 is, in a typical embodiment, the same as a diameter of the liquid-refrigerant inlet tube 108.

In a typical embodiment, relative and absolute dimensions of d1, d2, d3, d4, and h1 are as indicated in Table 1, although other relative and absolute dimensions may be utilized in accordance with design considerations. h2, which represents a blade outer edge length, will be discussed relative to FIG. 6D.

TABLE 1

| | Scaling factor | Example1 inch | Example2 inch |
|---|---|---|---|
| d1 | 1 | 0.3510 | 2.0000 |
| d2 | 0.3 | 0.1053 | 0.6000 |
| d3 | 1.5 | 0.5265 | 3.0000 |
| d4 | 2.3 | 0.8073 | 4.6000 |
| h1 | 1.346 | 0.4724 | 2.6920 |
| h2 | 1.693 | 0.5942 | 3.3860 |

Figure 6B:
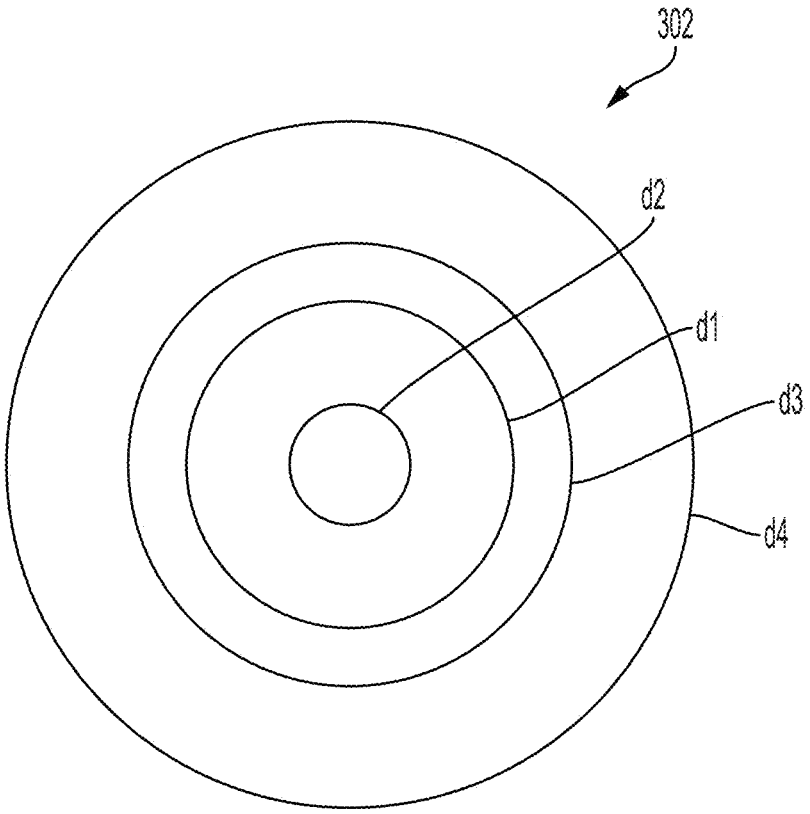
FIG. 6B is a schematic top view of the swirler of FIG. 5 that shows a blade angle of blades thereof.

FIG. 6B is a schematic top view of the swirler 302 that shows a blade angle of 60°, the blade angle being an angle between a leading edge of a given blade 502 and a trailing edge of the given blade 502 when the swirler 302 is viewed from the top. The blade angle 60° can be varied in accordance with design considerations.

Figure 6C:
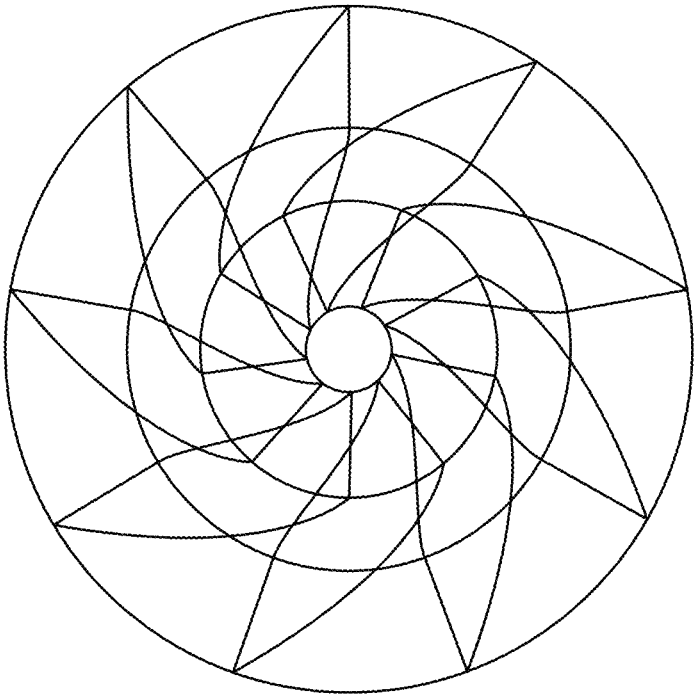
FIG. 6C is a schematic top view of the swirler of FIG. 5, in which nine blades are illustrated.

FIG. 6C is a schematic top view of the swirler 302 in which nine blades 502 are illustrated, each of which has a blade angle of 60° between the leading edge and the trailing edge thereof. Those having skill in the art will appreciate that the blade angle of 60° maybe varied in accordance with design considerations; however, it has been determined by the inventors that a blade angle of substantially 60° is, in at least some embodiments, optimal.

Figure 6D:
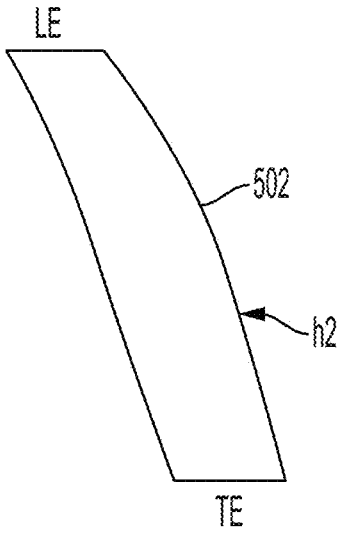
FIG. 6D is a side view of one of the blades of the swirler of FIG. 5.

FIG. 6D is a side view of one of the blades 502, the dimension h2 being shown thereon. The dimension h2 is an outer edge length of the blade 502 from the leading edge of the blade 502 to the trailing edge of the blade 502, the leading edge indicated by LE and the trailing edge indicated by TE in FIG. 6D. h2 is an unformed length of the blade 502, the term unformed referring to the blade 502 when in a flat configuration before being bent to be curved as shown, for example, in FIG. 5.

The term "substantially" is defined as largely but not necessarily wholly what is specified (and includes what is specified; e.g., substantially 90 degrees includes 90 degrees and substantially parallel includes parallel), as understood by a person of ordinary skill in the art. In any disclosed embodiment, the terms "substantially," "approximately," "generally," and "about" may be substituted with "within 10% of" what is specified.

Conditional language used herein, such as, among others, "can," "might," "may," "e.g.," and the like, unless specifically stated otherwise, or otherwise understood within the context as used, is generally intended to convey that certain embodiments include, while other embodiments do not include, certain features, elements and/or states. Thus, such conditional language is not generally intended to imply that features, elements and/or states are in any way required for one or more embodiments or that one or more embodiments necessarily include logic for deciding, with or without author input or prompting, whether these features, elements and/or states are included or are to be performed in any particular embodiment.

While the above detailed description has shown, described, and pointed out novel features as applied to various embodiments, it will be understood that various omissions, substitutions, and changes in the form and details of the devices or algorithms illustrated can be made without departing from the spirit of the disclosure. For example, various embodiments can be implemented with one or more of louvered fins, liquid and vapor flows interchanged, L&G coolers in two-stage compressor applications. As will be recognized, the processes described herein can be embodied within a form that does not provide all of the features and benefits set forth herein, as some features can be used or practiced separately from others. The scope of protection is defined by the appended claims rather than by the foregoing description. All changes which come within the meaning and range of equivalency of the claims are to be embraced within their scope.

What is claimed is:

1. A heat exchanger comprising:

a shell having an inlet and an outlet and forming a cavity;

wherein a first of a liquid refrigerant and a vapor refrigerant enters the inlet of the shell;

a coiled tube positioned within the cavity;

wherein a second of the liquid refrigerant and the vapor refrigerant enters the coiled tube; and a swirler positioned adjacent the inlet of the shell and comprising a frustoconical core, the frustoconical core having a first diameter at a leading edge adjacent the inlet of the shell and a second diameter at a trailing edge opposite the inlet of the shell, the first diameter being less than the second diameter.

2. The heat exchanger of claim 1, wherein the swirler is dimensioned to distribute the first of the liquid refrigerant and the vapor refrigerant across the coiled tube.

3. The heat exchanger of claim 1, wherein the swirler comprises a plurality of blades.

4. The heat exchanger of claim 1, wherein the swirler comprises a plurality of blades and the frustoconical core.

5. The heat exchanger of claim 4, wherein the plurality of blades extend from the frustoconical core.

6. The heat exchanger of claim 4, wherein the plurality of blades symmetrically extend from the frustoconical core about a circumference of the frustoconical core.

7. The heat exchanger of claim 4, wherein the plurality of blades extend from the frustoconical core, a first diameter of an outside portion of the plurality of blades being less than a second diameter of the outside portion of the plurality of blades.

8. The heat exchanger of claim 7, wherein:

the first diameter of the frustoconical core is less than a diameter of the inlet of the shell; and the first diameter of the outside portion of the plurality of blades is substantially equal to the diameter of the inlet of the shell.

9. The heat exchanger of claim 4, wherein the plurality of blades have a blade angle selected from substantially 40°, 45°, 50°, 55°, 60°, and 65°.

10. The heat exchanger of claim 9, wherein the blade angle is substantially 60°.

11. The heat exchanger of claim 4, wherein the plurality of blades are curved.

12. The heat exchanger of claim 4, wherein an outer surface of the frustoconical core and an outer surface of the plurality of blades are substantially parallel to one another.

13. The heat exchanger of claim 1, wherein the coiled tube comprises fins that increase an available surface area of the coiled tube.

14. The heat exchanger of claim 13, wherein the fins are louvered.

15. A heat exchanger configured to incorporate a swirler, the heat exchanger comprising:

a shell having an inlet and an outlet and forming a cavity;

wherein a first of a liquid refrigerant and a vapor refrigerant enters the inlet of the shell;

a coiled tube positioned within the cavity;

wherein a second of the liquid refrigerant and the vapor refrigerant enters the coiled tube; and wherein the swirler is positioned adjacent the inlet of the shell and comprising a frustoconical core, the frustoconical core having a leading edge adjacent the inlet of the shell and a trailing edge opposite the inlet of the shell, wherein a diameter of the leading edge is less than a diameter of the trailing edge.

16. The heat exchanger of claim 15, wherein the swirler is dimensioned to distribute the first of the liquid refrigerant and the vapor refrigerant across the coiled tube.

17. The heat exchanger of claim 15, wherein the swirler comprises a plurality of blades.

18. The heat exchanger of claim 17, wherein the plurality of blades have a blade angle selected from substantially 40°, 45°, 50°, 55°, 60°, and 65°.

19. The heat exchanger of claim 18, wherein the blade angle is substantially 60°.

20. The heat exchanger of claim 17, wherein the plurality of blades are curved.

* * * * *